US009238261B2

(12) United States Patent
Kong

(10) Patent No.: US 9,238,261 B2
(45) Date of Patent: Jan. 19, 2016

(54) SHEET LOADING SYSTEM WITH FIRST AND SECOND TRANSFER FEEDERS

(71) Applicant: Moon Gyu Kong, Ansan-si (KR)

(72) Inventor: Moon Gyu Kong, Ansan-si (KR)

(73) Assignee: GNS SOLITECH CO., LTD. (KR)

( * ) Notice: Subject to any disclaimer, the term of this patent is extended or adjusted under 35 U.S.C. 154(b) by 0 days.

(21) Appl. No.: 14/137,996

(22) Filed: Dec. 20, 2013

(65) Prior Publication Data

US 2014/0178159 A1 Jun. 26, 2014

(30) Foreign Application Priority Data

Dec. 21, 2012 (KR) ..... 10-2012-0150711

(51) Int. Cl.

| | |
|---|---|
| ***B21D 43/05*** | (2006.01) |
| ***B65H 5/16*** | (2006.01) |
| ***B65H 5/10*** | (2006.01) |
| ***B21D 43/18*** | (2006.01) |

(52) U.S. Cl.

CPC ..... *B21D 43/05* (2013.01); *B21D 43/18* (2013.01); *B65H 5/10* (2013.01); *B65H 5/16* (2013.01)

(58) Field of Classification Search

CPC .. B65G 47/912; B65G 47/918; B65G 47/901; B65G 25/08; B65G 37/02; B65G 41/003; B65G 41/008; B65G 41/02; B21D 43/18; B21D 43/05; B65H 5/16; B65H 5/10

See application file for complete search history.

(56) References Cited

U.S. PATENT DOCUMENTS

| | | | | | |
|---|---|---|---|---|---|
| 2,259,728 | A * | 10/1941 | Bridges | C03B 23/24 | 414/758 |
| 3,094,225 | A * | 6/1963 | Repasky | B65G 37/02 | 414/799 |
| 3,179,262 | A * | 4/1965 | Carlson, Sr. | B21D 43/05 | 271/14 |
| 3,799,317 | A * | 3/1974 | Shibata | B25J 5/02 | 414/564 |
| 5,191,964 | A * | 3/1993 | Spisak | B65G 47/918 | 198/447 |
| 5,233,815 | A * | 8/1993 | Kroger | B65G 47/842 | 53/168 |
| 6,000,327 | A * | 12/1999 | Moriyasu | B21D 43/05 | 198/621.1 |
| 8,016,281 | B1 * | 9/2011 | Sting | B43M 3/045 | 271/267 |
| 2003/0183486 | A1 * | 10/2003 | Meyer | B65G 47/901 | 198/470.1 |
| 2014/0174305 | A1 * | 6/2014 | Kong | B21D 43/18 | 100/193 |
| 2014/0178159 | A1 * | 6/2014 | Kong | B65H 5/16 | 414/222.01 |

FOREIGN PATENT DOCUMENTS

| | | | |
|---|---|---|---|
| KR | 10-0715422 | * | 5/2007 |
| KR | 100715422 | | 5/2007 |

OTHER PUBLICATIONS

Office Action for KR10-2012-0150711, mailed Mar. 6, 2014.

* cited by examiner

*Primary Examiner* — Gerald McClain

(57) ABSTRACT

A sheet loading system is provided for consecutively loading sheets onto a multi-step process press machine such that a plurality of workpieces loaded respectively on a plurality of workstations is simultaneously processed by one stroke. The sheet loading system includes a conveyor, a sheet loader, a first sheet transfer feeder, and a second sheet transfer feeder.

4 Claims, 10 Drawing Sheets

SHEET LOADING SYSTEM WITH FIRST AND SECOND TRANSFER FEEDERS

CROSS REFERENCE TO RELATED APPLICATION

This application claims the benefit of Korean Patent Application No. 10-2012-0150711, filed on Dec. 21, 2012, entitled "SHEET LOADING SYSTEM", which is hereby incorporated by reference in its entirety into this application.

BACKGROUND OF THE INVENTION

1. Technical Field

The present invention relates to a sheet loading system, and more particularly, to a sheet loading system for consecutively loading sheets onto a multi-step process press machine such that a plurality of workpieces loaded respectively on a plurality of workstations is simultaneously processed by one stroke.

2. Description of the Related Art

Press machines are machines for performing shearing work, forming work, and squeezing work on a variety of workpieces such as metals, plastics, and textiles, thereby producing products, and are suitable for mass production and thus are in widespread use throughout the industrial field. Press machines use press die sets having a variety of structures for a variety of work, such as cutting, punching, blanking, piercing, bending, drawing, and embossing, on workpieces. A press die set is composed of an upper die which is installed at a ram of a press machine, and a lower die which is installed at a bolster of the press machine. A ram is called a slide, and a bolster is also called a table. A press die set is called a punch, a cutter, or others according to its function.

A "MULTI-STEP PROCESS PRESS SYSTEM" of Korea Patent No. 10-0715422 simultaneously processes a plurality of workpieces loaded respectively on a plurality of workstations by one stroke, and sequentially loads workpieces onto the workstations, thereby finally producing complete products. The multi-step process press system is composed of a multi-step process press machine, a plurality of press die sets, a transfer feeder, a destacker, and a numerical control leveler feeder.

The transfer feeder simultaneously loads blank workpieces loaded respectively on the workstations of the multi-step process press machine, onto the subsequent units. The destacker is installed at one side of the press machine, and accommodates a large amount of blank workpieces, in a stacker, and sequentially loads the blank workpieces onto the workstations of the press machine. The numerical control leveler feeder is installed at the other side of the press machine, and sequentially loads roll type coil workpieces onto the workstations of the press machine. The numerical control leveler feeder is composed of an uncoiler in which a coil workpiece is set and which uncoils the coil workpiece, and a leveler which linearly processes the coil workpiece uncoiling from the uncoiler.

Since the multi-step process press system according to the related art as described above is configured to perform press work while consecutively loading blank workpieces or coil workpieces onto the multi-step process press machine, the multi-step process press system is difficult to applied for processing sheets into the workpieces. That is, in order for efficiency processing of a press machine, it is needed to consecutively and stably load sheets; however, there is a problem in which the configuration of a sheet feeder for loading sheets becomes complicated. Also, since a large amount of dead time occurs in loading sheets, and thus a processing speed remarkably decreases, there are problems in which productivity decreases and the cost of production increases.

SUMMARY OF THE INVENTION

The present invention is for solving a variety of problems of multi-step process press systems according to the related art as described above. An object of the present invention is to provide a new sheet loading system capable of consecutively and stably loading sheets onto a multi-step process press machine.

Another object of the present invention is to provide a sheet loading system capable of loading sheets such that the sheets can be sequentially subjected to press work at a plurality of workstations by one stroke, thereby improving productivity and remarkably reducing the cost of production.

According to one aspect of the present invention, a sheet loading system is provided. The sheet loading system according to the present invention includes: a conveyor that is installed at the upstream of a press machine, which has an X-axis direction, a Y-axis direction, a Z-axis direction, and a press line aligned with the X-axis direction, along the Y-axis direction, so as to be adjacent to the press machine, and transfers sheets; a sheet loader that is installed along the Y-axis direction such that the sheet loader is adjacent to the conveyor, and takes over the sheets from the conveyor, and transfers the sheets to the press line; a first sheet transfer feeder that is installed between the press machine and the sheet loader, and takes over the sheets from the sheet loader, and transfers the sheets toward a first workstation; and a second sheet transfer feeder that is installed between the press machine and the first sheet transfer feeder, and takes over the sheets from the first sheet transfer feeder, and transfers the sheets to the first workstation.

The sheet loading system according to the present invention has a beneficial effect in which it is possible to consecutively and stably load sheets onto workstations of the press machine by the sheet loading system, such that the sheets can be sequentially subjected to press work by one stroke, thereby improving productivity and remarkably reducing the cost of production.

DESCRIPTION OF THE PREFERRED EMBODIMENTS

Other objects, specific advantages, and new features of the present invention will be more apparent from preferable embodiments and the following detailed description associated with the accompanying drawings.

Hereinafter, preferable embodiments of a sheet loading system according to the present invention will be described in detail with reference to the accompanying drawings.

Figure 1:
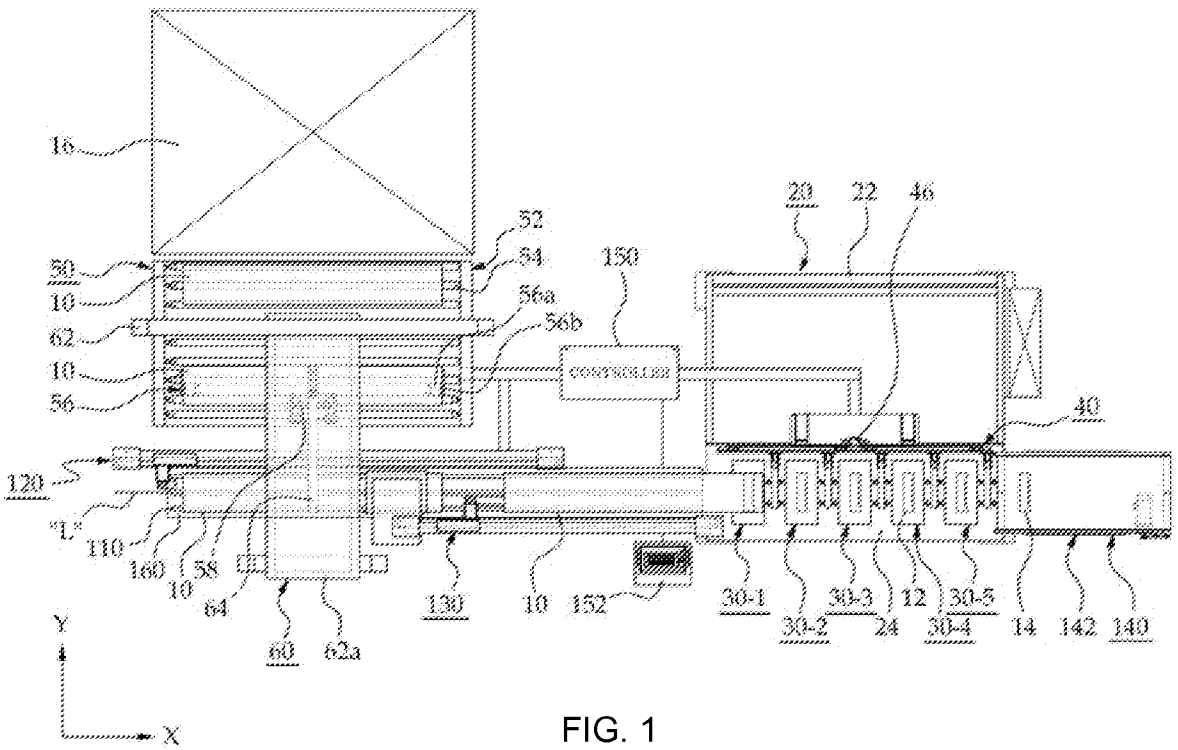
FIG. 1 is a plan view illustrating the configuration of a multi-step process press system using a sheet loading system according to the present invention.
Figure 2:
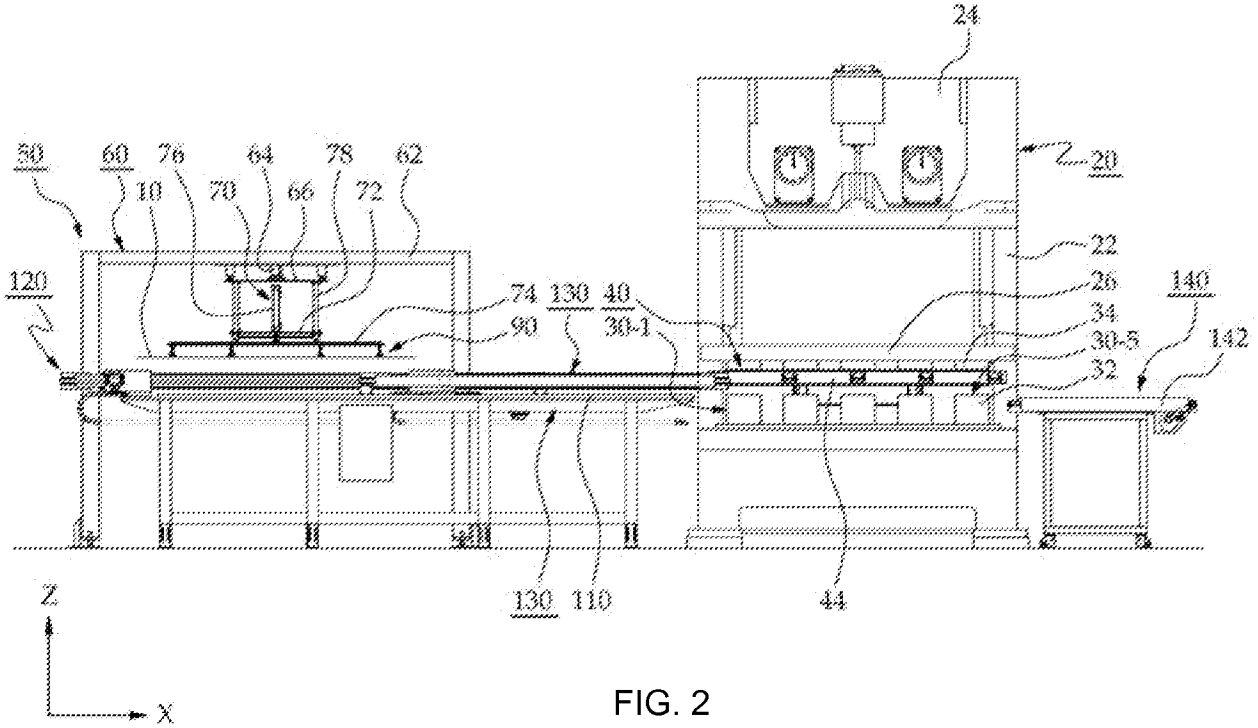
FIG. 2 is a front view illustrating the configuration of the multi-step process press system using the sheet loading system according to the present invention.
Figure 3:
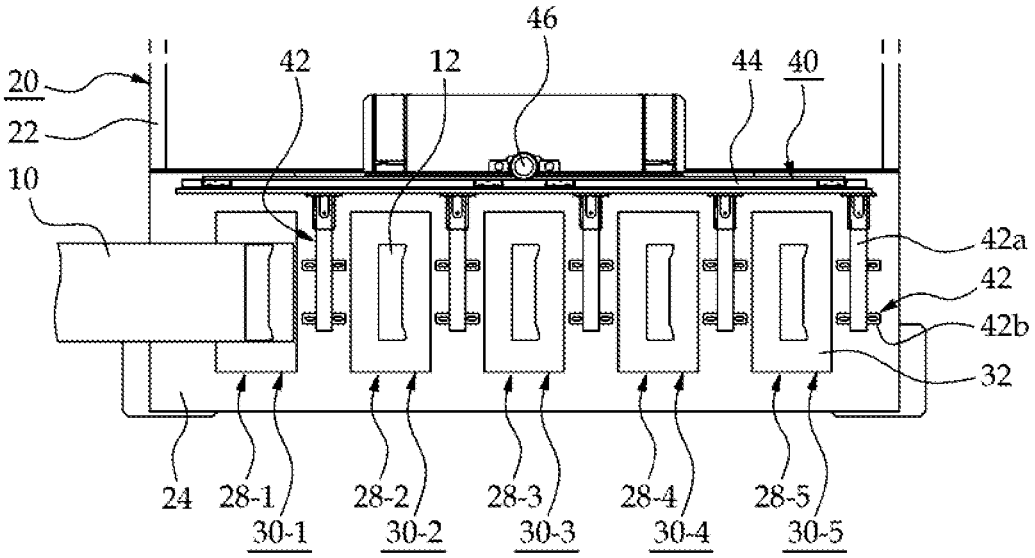
FIG. 3 is a plan view illustrating the configuration of workstations of a press machine and a transfer feeder in the multi-step process press system using the sheet loading system according to the present invention.
Figure 4:
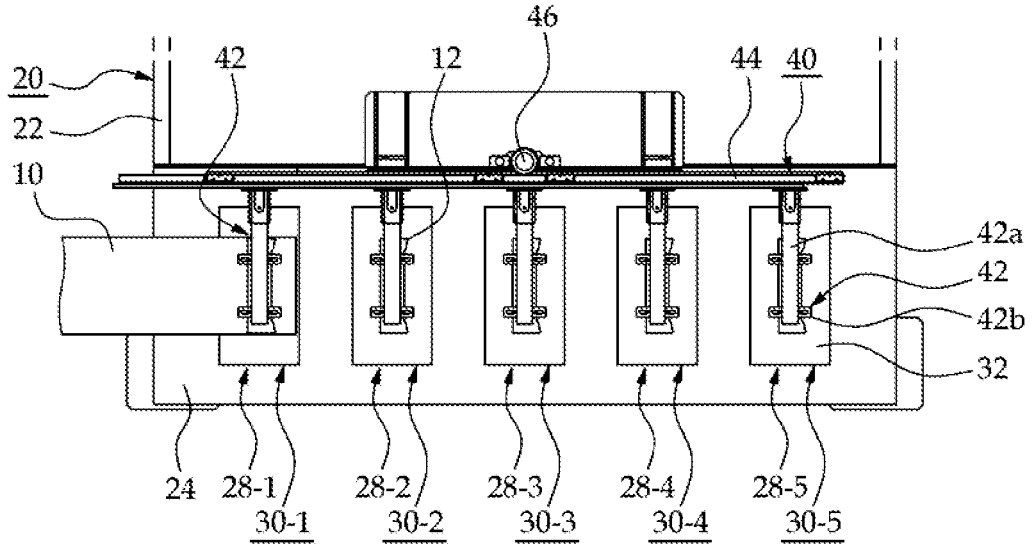
FIGS. 4 and 5 are plan views for explaining the operation of the transfer feeder in FIG. 3.
Figure 5:
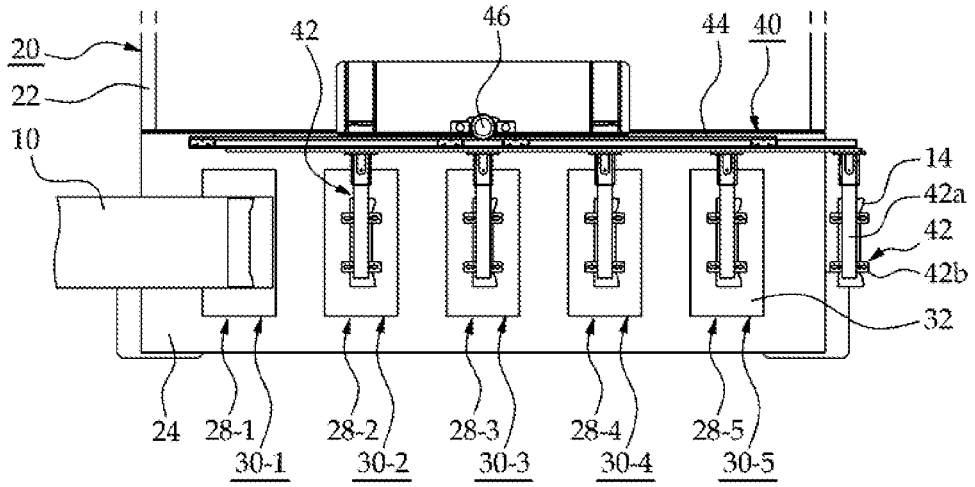

First, referring to FIGS. 1 to 3, a multi-step process press system using the sheet loading system according to the present invention includes a press machine 20 which sequentially perform press work on sheets 10, such as metal sheets, which are workpieces, by one stroke. A press frame 22 constitutes the external appearance of the press machine 20 and has an X-axis direction, a Y-axis direction perpendicular to the X-axis direction, and a Z-axis direction perpendicular to the X-axis direction and the Y-axis direction. The sheets 10 are loaded along a press line L of the press machine 20, and then are sequentially subjected to press work, whereby complete products 14 are produced from sheets 10 through blank workpieces 12. The press line L along which transfer of the sheets 10 and the blank workpieces 12 is performed is aligned along the X-axis direction. In other embodiments, the press line L may be aligned along the Y-axis direction.

The press machine 20 is composed of a bolster 24 which is installed on the press frame 22, and a ram 26 which is installed on the press frame 22 above the bolster 24 so as to be able to linearly reciprocate along the Z-axis direction. The press machine 20 may be composed of a known hydraulic press such that linear reciprocation of the ram 26 along the Z-axis direction is performed by hydraulic pressure. Also, the press machine 20 may be composed of a known mechanical press such that linear reciprocation of the ram 26 along the Z-axis direction is performed by a mechanism such as a crank, an eccentric, a toggle, a link, and a cam.

A plurality of workstations 28-1 to 28-5 are provided in series at intervals along the X-axis direction between the bolster 24 and the ram 26 in order to perform press work on the sheet 10 into the complete products 14. At the first workstation 28-1 of the plurality of workstations 28-1 to 28-5, each sheet 10 is blanked, thereby being processed into a blank workpiece 12. In FIG. 3, a configuration having five workstations 28-1 to 28-5 is shown. However, the number of workstations can be appropriately increased or decreased according to the form of press work.

Referring to FIGS. 1 to 5, a plurality of press die sets 30-1 to 30-5 is installed respectively at the workstations 28-1 to 28-5 of the press machine 20. Each of the press die sets 30-1 to 30-5 is composed of a lower die 32 installed at the upper surface of the bolster 24, and an upper die 34 installed at the lower surface of the ram 26 so as to be fit with the lower die 32. The upper dies 34 are lifted and lowered between a die open position and a die close position by the operation of the ram 26. In other embodiments, the press machine 20 may be composed of a tandem press in which a plurality of press machines is arranged in series. In this case, press die sets are installed respectively at the press machines constituting the tandem press.

A transfer feeder 40 is installed at the press machine 20 so as to simultaneously unload the blank workpieces 12 loaded respectively on the lower dies 32 of the press die sets 30-1 to 30-5, and simultaneously load the blank workpieces 12 onto the subsequent units. Also, the transfer feeder 40 unloads each complete product 14 loaded on the lower die 32 of the last workstation 28-5, from the last workstation 28-5.

The transfer feeder 40 is composed of a vacuum pad unit 42, an X-axis linear actuator 44, and a Z-axis linear actuator 46. The vacuum pad unit 42 is installed between the bolster 24 and the ram 26 of the press machine 20 so as to be able to move along the X-axis direction, that is, the loading direction of the blank workpieces 12, and the Z-axis direction, and simultaneously absorbs the blank workpieces 12 loaded on the workstations 28-1 to 28-5. The X-axis linear actuator 44 is installed so as be able to move the vacuum pad unit 42 along the X-axis direction, and the Z-axis linear actuator 46 is installed so as to be able to move the X-axis linear actuator 44 along the Z-axis direction.

The vacuum pad unit 42 is composed of an arm 42*a* which is installed to be able to move along the X-axis direction of the press machine 20, and a plurality of vacuum pads 42*b* which is installed on the arm 42*a* so as to be able to simultaneously absorb the blank workpieces 12 loaded on the lower dies 32 of the press die sets 30-1 to 30-5. The vacuum pads 42*b* are connected to a vacuum pump or an air compressor well-known as an air suction device for sucking air, through pipelines.

The X-axis linear actuator 44 is installed along the X-axis direction, and is joined with the arm 42*a* so as to be able to move the arm 42*a* of the vacuum pad unit 42 along the X-axis direction. The Z-axis linear actuator 46 is installed along the Z-axis direction, and is joined with the X-axis linear actuator 44 so as to be able to move the X-axis linear actuator 44 along the Z-axis direction. Each of the X-axis and Z-axis linear actuators 44 and 46 is composed of a servo motor for providing a driving force, a lead screw which rotates by the driving force of the servo motor, a nut block which is fit so as to perform screw motion along the lead screw, a carriage which is fixed to the nut block, and a guide rail which guides linear motion of the carriage. The lead screw may be composed of a ball screw, and the nut block may be composed of a ball nut block. The guide rail may be composed of a guide bar, instead of a mono-rail type.

Meanwhile, in some embodiments, each of the X-axis and Z-axis linear actuators 44 and 46 may be composed of a belt driven linear actuator in which a carriage is linearly moved by a timing belt. Also, each of the X-axis and Z-axis linear actuators 44 and 46 may be composed of an air cylinder, a carriage, and a linear guide, or may be composed of a servo motor, a rack and pinion, a carriage, and a linear guide.

Figure 6:
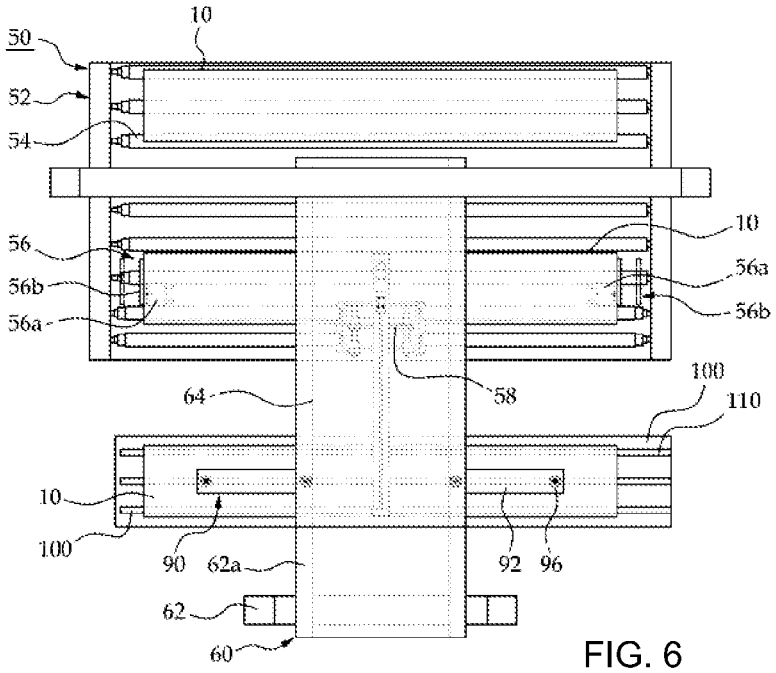
FIG. 6 is a plan view illustrating the configuration of a conveyor and a sheet loader in the sheet loading system according to the present invention.
Figure 7:
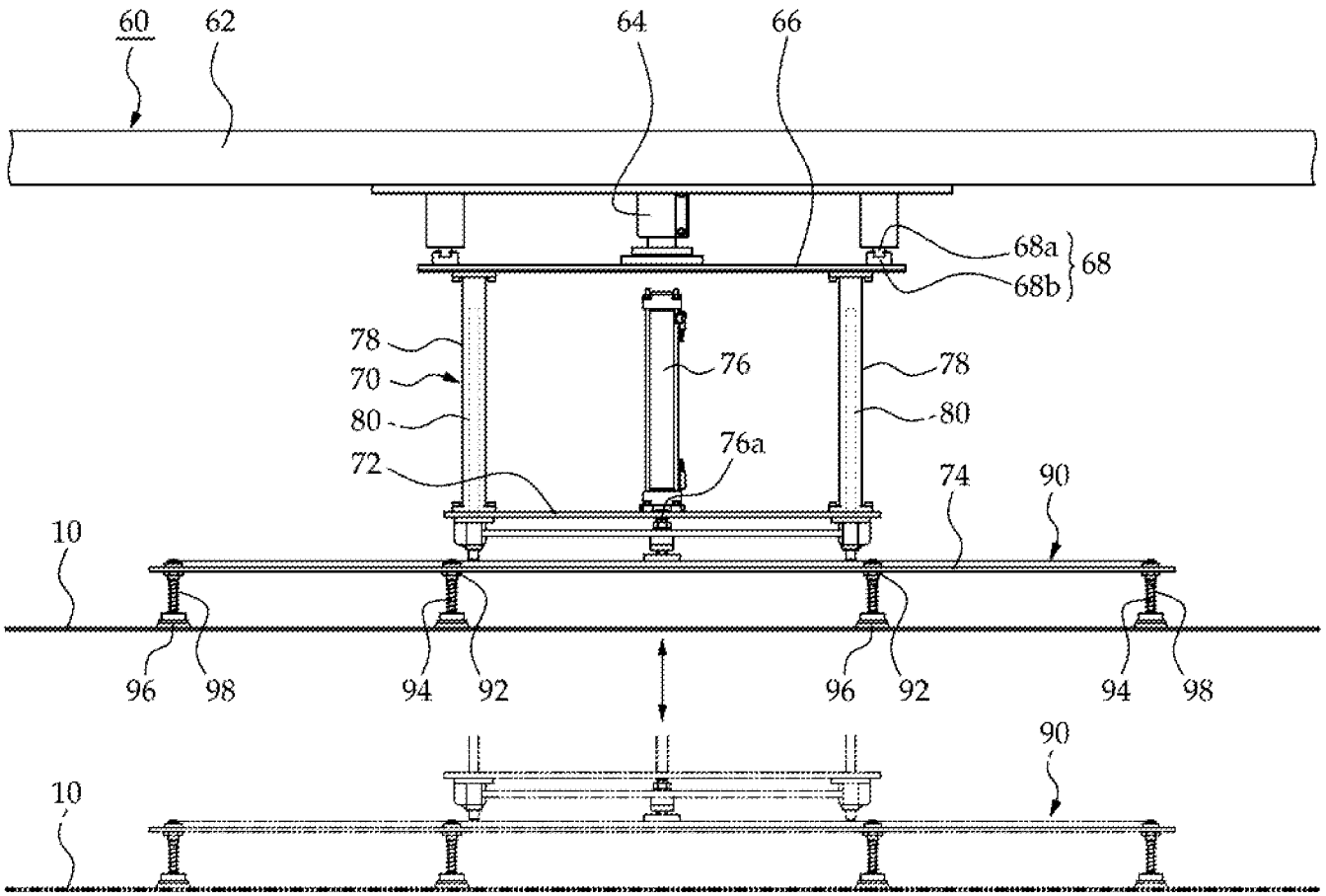
FIG. 7 is a front view for explaining the operation of the sheet loader in the sheet loading system according to the present invention.
Figure 8:
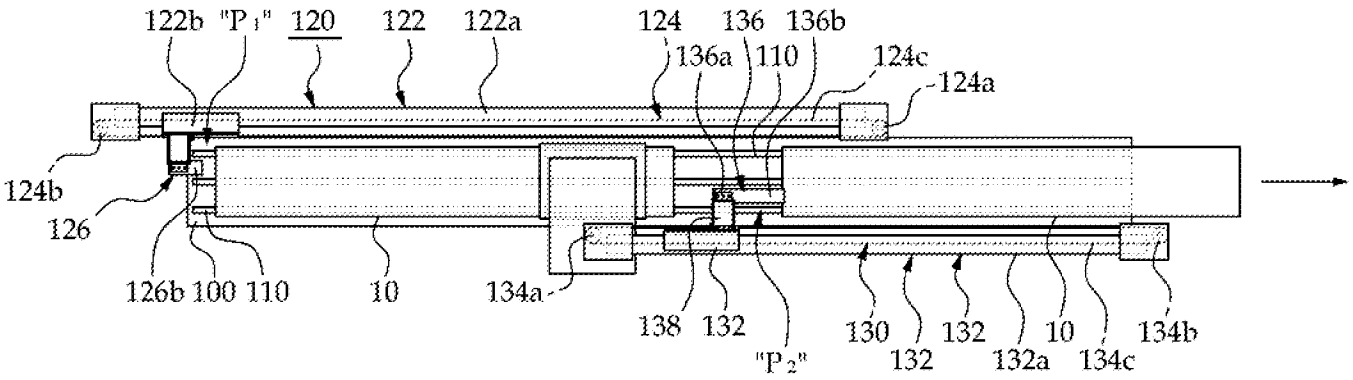
FIG. 8 is a plan view illustrating the configuration of first and second sheet transfer feeders in the sheet loading system according to the present invention.
Figure 9:
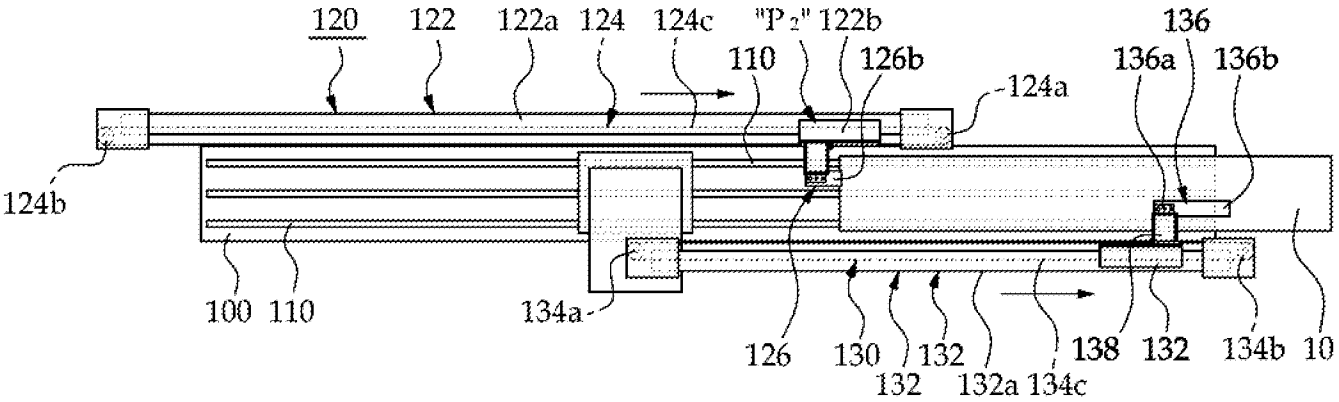
FIG. 9 is a plan view for explaining the operations of the first and second sheet transfer feeders in FIG. 8.
Figure 10:
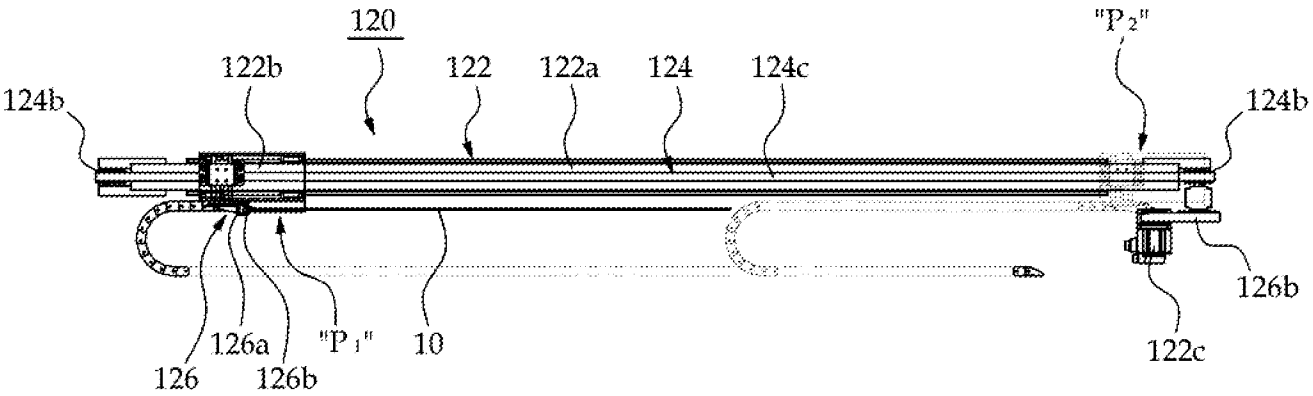
FIG. 10 is a front view illustrating the configuration of the first sheet transfer feeder in the sheet loading system according to the present invention.

Referring to FIGS. 1, 2, and 6, a sheet loading system 50 according to the present invention is installed at the upstream of the press machine 20 in order to consecutively load the sheets onto the first workstation 28-1 of the plurality of workstations 28-1 to 28-5. A conveyor 52 of the sheet loading system 50 is installed at the upstream of the press machine 20 along the Y-axis direction so as to neighbor the press machine 20.

Each sheet 10 is formed by shearing of a shearing machine 16 or cutting of a cutting machine, and is transferred to the conveyor 52. The shearing machine 16 is installed at the upstream of the conveyor 52, and shears a roll-type metal coil into sheets, and loads the sheets onto the upstream of the conveyor 52. The conveyor 52 takes over the sheets 10 from the shearing machine 16, and transfers the sheets 10 to the upstream of the press machine 20. The conveyor 52 is installed along the Y-axis direction between the press line L and the shearing machine 16 so as to connect the press line L and the shearing machine 16. The conveyor 52 is composed of a roller conveyor 54. In the present embodiment, the roller conveyor 54 may be composed of a belt conveyor.

As shown in FIG. 1, a centering device 56 is installed on the roller conveyor 54 in order for centering of each sheet 10 being transferred along the roller conveyor 54. The centering device 56 is composed of one pair of actuators 56*a* and one pair of pushers 56*b*. The actuators 56*a* are installed at an interval along the width direction of the roller conveyor 54, such that the actuators face each other. The pushers 56*b* approach each other or move away from each other by the operations of the actuators 56*a* so as to support both ends of each sheet 10, thereby performing centering of the corresponding sheet 10. The actuators 56*a* may be composed of air cylinders. At a position neighboring the leading end of the roller conveyor 54, a stopping unit 58 is installed. Each sheet 10 is caught by the stopping unit 58, thereby being stopped at a determined position on the roller conveyor 54.

Referring to FIGS. 1, 2, 6, and 7, the sheet loading system 50 according to the present invention includes a sheet loader 60 which takes over the sheets 10 from the conveyor 52 and loads the sheets 10 onto the press line L. The sheet loader 60 is installed between the press machine 20 and the conveyor 52. The sheet loader 60 is composed of a loader frame 62, a Y-axis linear actuator 64, and a slide plate 66. An overhead plate 62*a* of the loader frame 62 is disposed over the conveyor 52 so as to cross the press line L and the conveyor 52 along the Y-axis direction.

The Y-axis linear actuator 64 is installed along the Y-axis direction on the lower surface of the overhead plate 62*a*. The Y-axis linear actuator 64 may be composed of a screw driven linear actuator, which includes a servo motor that provides a driving force, a lead screw that rotates by the driving force of the servo motor, a nut block that is fit so as to perform screw motion along the lead screw, and a carriage that is fixed to the nut block. In some embodiments, the Y-axis linear actuator 64 may be composed of a belt driven linear actuator, an air cylinder, or the like. Also, the Y-axis linear actuator 64 may be composed of an air cylinder, a carriage, and a linear guide, or may be composed of a servo motor, a rack and pinion, a carriage, and a linear guide.

The slide plate 66 is connected to the Y-axis linear actuator 64 so as to be able to linearly move along the Y-axis direction. One pair of linear guides 68 is installed on both sides between the overhead plate 62*a* and the slide plate 66 so as to guide linear motion of the slide plate 66. The linear guides 68 are composed of guide rails 68*a* which are installed along the Y-axis direction on the overhead plate 62*a*, and a plurality of slides 68*b* which is installed to be slidable along the guide rails 68*a* and is connected to the slide plate 66.

The sheet loader 60 includes a lifting unit 70 for lifting and lowering each sheet 10. The lifting unit 70 is composed of a mounting plate 72, a lifting plate 74, and a lifting cylinder 76. The mounting plate 72 is disposed below the slide plate 66, and is connected to the slide plate 66 by a plurality of support pipes 78.

The lifting plate 74 is disposed below the mounting plate 72 so as to be able to be lifted and lowered along the Z-axis direction. The lower ends of a plurality of guide bars 80 are fixed to the upper surface of the lifting plate 74. The guide bars 80 are inserted into the support pipes 78, and guide lifting and lowering of the lifting plate 74. The lifting cylinder 76 is installed at the center of the upper surface of the mounting plate 72. A cylinder rod 76*a* of the lifting cylinder 76 passes through the mounting plate 72 and is connected to the upper surface of the lifting plate 74.

The sheet loader 60 includes a plurality of vacuum pad units 90 which is installed on the lifting plate 74 and absorbs each sheet 10. The vacuum pad units 90 are composed of guide bushes 92, rods 94, vacuum pads 96, and springs 98. The guide bushes 92 are installed on the lifting plate 74. The rods 94 are inserted into the guide bushes 92 so as to be able to be lifted and lowered along the guide bushes 92. The vacuum pads 96 are installed at the lower ends of the rods 94. The springs 98 are installed around the rods 94, and buffer a load on the vacuum pads 96. The vacuum pads 96 are connected to a vacuum pump or an air compressor well-known as an air suction device for sucking air, by pipelines. If the vacuum pump is operated in a state where the vacuum pads 96 are in close contact with the surface of a sheet 10, such that air is discharged from the insides of the vacuum pads 96, the vacuum pads 96 absorb the sheet 10.

Referring to FIGS. 1, 2, and 8 to 11, the sheet loading system 50 according to the present invention includes a feeder frame 100, a plurality of guide rails 110 for guiding the sheets 10 to the first workstation 28-1 along the press line L, a first sheet transfer feeder 120, and a second sheet transfer feeder 130.

The feeder frame 100 is installed along the X-axis direction between the press machine 20 and the sheet loader 60. The plurality of guide rails 110 for guiding transfer of the sheets 10 is installed on the upper surface of the feeder frame 100 in parallel with the press line L. Each sheet 10 is transferred while being slid along the guide rails 110. The guide rails 110 provide a first position $P_1$ located at a long distance from the press machine 20, and a second position $P_2$ located between the first workstation 28-1 and the first position $P_1$. The second position $P_2$ is set to a position located at about two thirds of the length of the guide rails 110 from the first position $P_1$. In other embodiments, the second position $P_2$ may be set to a position located at about one half of the length of the guide rails 110 from the first position $P_1$.

The sheet loader 60 takes over each sheet 10 from the conveyor 52, and loads the corresponding sheet 10 onto the guide rails 110 at the first position $P_1$. The first sheet transfer feeder 120 is installed along the X-axis direction between the press machine 20 and the sheet loader 60, and transfers the sheets 10 from the first position $P_1$ to the second position $P_2$ along the guide rails 110. The second sheet transfer feeder 130 is installed between the press machine 20 and the first sheet transfer feeder 120, and takes over each sheet 10 from the first sheet transfer feeder 120, and transfers the corresponding sheet 10 to the first workstation 28-1.

The first and second sheet transfer feeders 120 and 130 are installed on both sides of the guide rails 110 along the X-axis direction, such that they face each other. A linear actuator 122 of the first sheet transfer feeder 120 is composed of a guide 122*a*, a carriage 122*b*, a servo motor 122*c*, and a belt drive 124, and a linear actuator 132 of the second sheet transfer feeder 130 is composed of a guide 132*a*, a carriage 132*b*, a servo motor 132*c*, and a belt drive 134. The guides 122*a* and 132*a* are installed in parallel with the guide rails 110. The carriage 122*b* is installed on one side of the guide 122*a* so as to be transferred along the guide 122*a*, and the carriage 132*b* is installed on one side of the guide 132*a* so as to be transferred along the guide 132*a*. The servo motor 122*c* is installed on one side of the guide 122*a*, and provides a driving force for transferring the carriage 122*b*, and the servo motor 132*c* is installed on one side of the guide 132*a*, and provides a driving force for transferring the carriage 132*b*. The belt drive 124 is composed of a drive pulley 124*a* which is connected to the servo motor 122*c*, and is rotated by driving of the servo motor 122*c*, a driven pulley 124*b* which is installed on one side of the guide 122*a* so as to be rotatable, and a belt 124*c* which is wound around the drive pulley 124*a* and the driven pulley 124*b*. The belt drive 134 is composed of a drive pulley 134*a* which is connected to the servo motor 132*c*, and is rotated by driving of the servo motor 132*c*, a driven pulley 134*b* which is installed on one side of the guide 132*a* so as to be rotatable, and a belt 134*c* which is wound around the drive pulley 134*a* and the driven pulley 134*b*. The belt drives 124 and 134 may be composed of timing belt drives. Parts of the belts 124*c* and 134*c* are connected respectively to the carriages 122*b* and 132*b*. The carriages 122*b* and 132*b* linearly move along the guides 122*a* and 132*a* by running of the belts 124*c* and 134*c*, respectively. In the present embodiment, the configuration in which each of the linear actuators 122 and 132 is composed of a belt driven linear actuator has been described and is shown in the drawings, however, each of the linear actuators 122 and 132 may be variously composed of a screw driven actuator, a rack and pinion driven linear actuator, or the like.

Clamping units 126 and 136 of the first and second sheet transfer feeders 120 and 130 are installed respectively at the carriages 122*b* and 132*b* so as to be able to clamp each sheet 10. The clamping unit 126 is composed of the actuator 126*a* which is installed on one side of the carriage 122*b*, and one pair of jaws 126*b* which clamp each sheet 10 by the operation of the actuator 126*a*, and the clamping unit 136 is composed of the actuator 136*a* which is installed on one side of the carriage 132*b*, and one pair of jaws 136*b* which clamps each sheet 10 by the operation of the actuator 136*a*. In the present embodiment, each of the clamping units 126 and 136 may be configured to have an electromagnet so as to be able to clamp each sheet 10. The second sheet transfer feeder 130 includes an up down actuator 138 which lifts and lowers the clamping unit 136. The up down actuator 138 is installed on the carriage 132*b*. The clamping unit 136 is installed on the up down actuator 138. The up down actuator 138 is composed of an air cylinder.

an unloarder 140 is installed on the other side of the press machine 20 so as to be able to discharge the complete products 14 from the press machine 20. The unloarder 140 is composed of a belt conveyor 142. The transfer feeder 40 absorbs each complete product 14 loaded on the lower die 32 of the final press die set 30-5 of the press die sets 30-1 to 30-5, by the vacuum pads 42*b*, and transfers the corresponding complete product 14 onto the belt conveyor 142. The complete products 14 are transferred from the press machine 20 by the operation of the belt conveyor 142.

As shown in FIG. 1, the multi-step process press system using the sheet loading system 50 according to the present invention includes a controller 150 which controls the operations of the press machine 20, the transfer feeder 40, the conveyor 52, the sheet loader 60, the first and second sheet transfer feeders 120 and 130, and the unloarder 140. The controller 150 performs sequence control on the operations of the press machine 20, the transfer feeder 40, the conveyor 52, the sheet loader 60, the first and second sheet transfer feeders 120 and 130, and the unloarder 140. The controller 150 is connected to an input unit 152 for setting of a mode. The input unit 152 is composed of a key board, a touch panel, a plurality of buttons and switches, or the like.

Hereinafter, the operations of the sheet loading system having the above described configuration according to the present invention will be described.

Referring to FIGS. 1 and 6, the sheets 10 are formed by shearing of the shearing machine 16, and are loaded onto the roller conveyor 54. The sheets 10 are transferred from the shearing machine (16) side toward the press line (L) side by the operation of the roller conveyor 54. At this time, the actuators 56*a* of the centering device 56 are operated such that the pushers 56*b* approach each other, the pushers 56*b* support both ends of each sheet 10 being transferred along the roller conveyor 54. Therefore, each sheet 10 is centered while passing between the pushers 56*b*. Each sheet 10 being transferred by the operation of the roller conveyor 54 is caught by the stopping unit 58, thereby being stopped at the determined position on the roller conveyor 54. If transferring of the sheets 10 is completed, the roller conveyor 54 is stopped, and the pushers 56*b* are returned by the operations of the actuators 56*a*.

Referring to FIGS. 1, 2, 6, and 7, if the lifting cylinder 76 of the sheet loader 60 is operated such that the cylinder rod 76*a* advances, the lifting plate 74 is lowered. Due to the lowering of the lifting plate 74, the vacuum pads 96 of the vacuum pad units 90 absorb a sheet 10 loaded on the roller conveyor 54. Thereafter, if the lifting cylinder 76 is operated such that the cylinder rod 76*a* retreats, the lifting plate 74 is lifted.

Next, if the lifting plate 74 is stopped after being lifted, the Y-axis linear actuator 64 is operated such that the slide plate 66 is transferred to the press line L. If the sheet 10 absorbed by the vacuum pad units 90 is aligned with the press line L, the Y-axis linear actuator 64 is stopped.

Thereafter, if the lifting cylinder 76 is operated such that the cylinder rod 76*a* advances, the lifting cylinder 76 is lowered. If the lifting plate 74 is lowered such that the sheet 10 is supported on the guide rails 110, vacuum of the vacuum pads 96 is released, whereby the sheet 10 is separated from the vacuum pads 96 and is loaded on the guide rails 110. Thereafter, the lifting cylinder 76 is operated such that the cylinder rod 76*a* retreats, whereby the lifting plate 74 is lifted. Thereafter, the Y-axis linear actuator 64 is driven in the opposite direction to that described above, thereby returning the slide plate 66 to the shearing machine 16 side, and then stops.

Referring to FIGS. 1, 2, and 8 to 11, if the sheet 10 is loaded on the guide rails 110, the clamping unit 126 of the first sheet transfer feeder 120 is operated. Due to the operation of the actuator 126*a*, one pair of clamps 124 clamps the sheet 10 while being closed. If the clamping unit 126 clamps the sheet 10, the servo motor 122*c* is driven in one direction such that the belt 124*c* of the belt drive 124 runs. Due to the running of the belt 124*c*, the carriage 122*b* is transferred from the first position $P_1$ to the second position $P_2$ along the guide 122*a*. If the carriage 122*b* is transferred to the second position $P_2$, the servo motor 122*c* is stopped.

Figure 11:
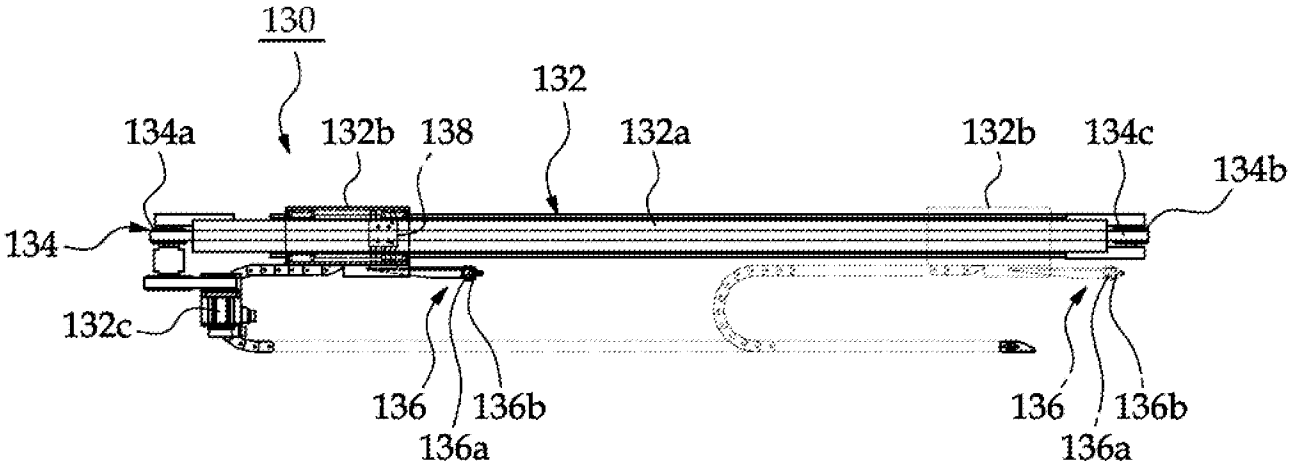
FIG. 11 is a front view illustrating the configuration of the second sheet transfer feeder in the sheet loading according to the present invention.
Figure 12:
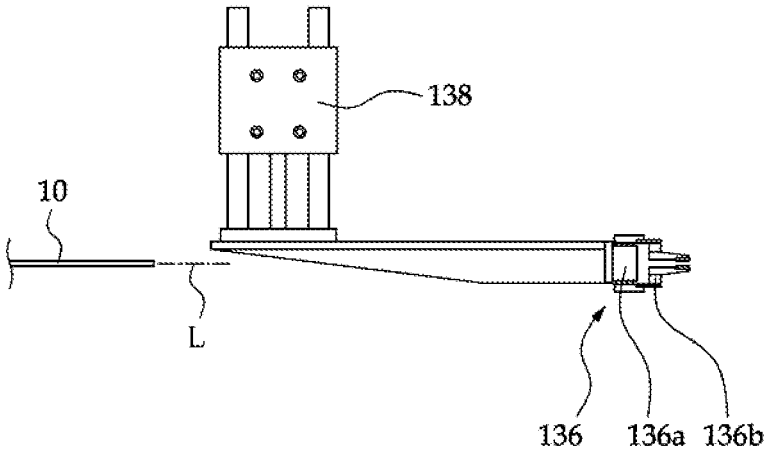
FIGS. 12 and 13 are plan views for explaining the operation of a clamping unit of the second sheet transfer feeder in the sheet loading system according to the present invention.
Figure 13:
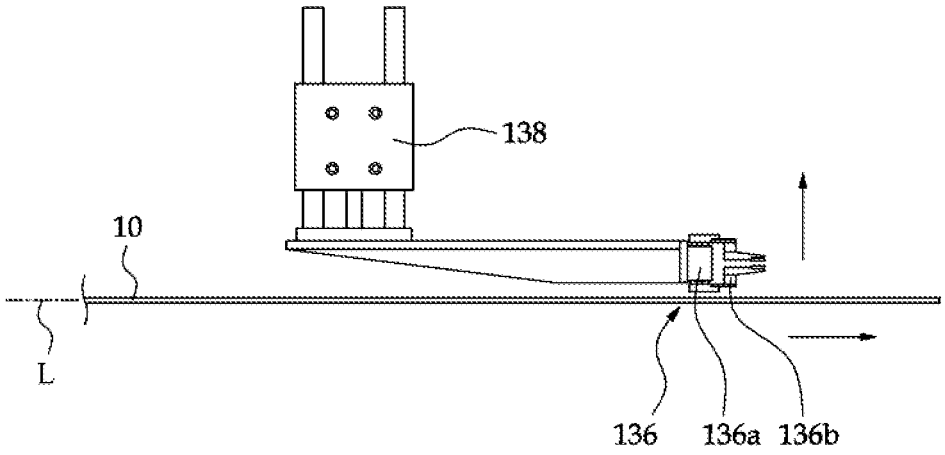

Referring FIGS. 11 to 13, when the carriage 122*b* of the first sheet transfer feeder 120 is transferred from the first position $P_1$ to the second position $P_2$, the up down actuator 138 is operated so as to lift the clamping unit 136 of the second sheet transfer feeder 130. Due to the lifting of the clamping unit 136, the clamping unit 136 gets out of the feeding line of the sheet 10 being transferred by the operation of the first sheet transfer feeder 120, that is, the press line L. Therefore, it is possible to smoothly transfer the sheet 10 without collision between the sheet 10 and the clamping unit 136.

Referring to FIGS. 8 to 11, after the first sheet transfer feeder 120 first transfers the sheet 10 to the second position $P_2$, the servo motor 122*c* of the first sheet transfer feeder 120 is driven in the opposite direction to that described above, so as to return the carriage 122*b* from the second position $P_2$ to the first position $P_1$. If the carriage 122*b* of the first sheet transfer feeder 120 is returned, the up down actuator 138 is operated so as to lower the clamping unit 136.

Subsequently, the clamping unit 136 of the second sheet transfer feeder 130 clamps the sheet 10, and the jaws 126*b* are opened by the operation of the actuator 126*a*, thereby releasing the clamping of the sheet 10. After taking over the sheet 10 from the first sheet transfer feeder 120 at the second position $P_2$, the second sheet transfer feeder 130 transfers the sheet 10 to the first workstation 28-1. The sheet 10 having been clamped by the jaws 126*b* is loaded onto the lower die 32 of the first workstation 28-1. If the sheet 10 is loaded onto the lower die of the first workstation 28-1, the servo motor 132*c* is stopped.

If the sheet 10 is loaded onto the first workstation 28-1 by the operation of the second sheet transfer feeder 130, the ram 26 is lowered. If the ram 26 is lowered, at the first workstation 28-1, the sheet 10 is blanked into a blank workpiece 12 by the lower die 32 and the upper die 34 of the first press die set 30-1. If press work on the sheet 10 is completed, the carriage 132*c* of the second sheet transfer feeder 130 is returned, and the first sheet transfer feeder 120 clamps the sheet 10 having been secondly loaded on the guide rails 110, at the first position $P_1$, and transfers the sheet 10 to the second position $P_2$.

Referring to FIGS. 1 to 5, if the ram 26 is lifted, thereby being returned, the X-axis and Z-axis linear actuators 44 and 46 of the transfer feeder 40 are operated to bring the vacuum pads 42*b* into close contact with the blank workpiece 12 loaded on the lower die 32 of the first press die set 30-1. If the vacuum pads 42*b* absorb the blank workpiece 12, the X-axis and Z-axis linear actuators 44 and 46 are operated to load the blank workpiece 12 onto the lower die 32 of the second press die set 30-2.

Loading of the sheet 10 by the operations of the first and second sheet transfer feeders 120 and 130, unloading of the blank workpiece 12 by the operation of the transfer feeder 40, and press work by the operation of the press machine 20 are sequentially performed, whereby a complete product 14 is produced from the sheet 10. If the complete product 14 is finally produced at the final workstation 28-5 of the workstations 28-1 to 28-5, the complete product 14 is loaded from the final workstation 28-5 onto the belt conveyor 142 by the operation of the transfer feeder 40. Thereafter, by the operation of the belt conveyor 142, the complete product 14 is unloaded. As described above, the sheet loading system 50 of the present invention sequentially, accurately, and smoothly loads the sheets 10 onto the press machine 20 by the operations of the first and second sheet transfer feeders 120 and 130, and then simultaneously performs press work on the sheets 10, thereby capable of improving productivity and reducing the cost of production.

The above described embodiment is merely a preferred embodiment of the present invention, and the scope of the present invention is not limited to the above described embodiment. The above described embodiment can be variously changed, modified, and replaced within the technical idea of the present invention and claims by those skilled in this art, and it should be understood that those embodiments are included in the scope of the present invention.

What is claimed is:

1. A sheet loading system comprising:

a conveyor that is installed along a Y-axis direction at the upstream of a press machine, which has an X-axis direction, the Y-axis direction, a Z-axis direction, and a press line aligned with the X-axis direction so as to be adjacent to the press machine, and transfers sheets;

a sheet loader that is installed along the Y-axis direction such that the sheet loader is adjacent to the conveyor, and takes over the sheets from the conveyor, and transfers the sheets to the press line;

a first sheet transfer feeder that is installed between the press machine and the sheet loader, and takes over the sheets from the sheet loader, and transfers the sheets toward a first workstation;

a second sheet transfer feeder that is installed between the press machine and the first sheet transfer feeder, and takes over the sheets from the first sheet transfer feeder, and transfers the sheets to the first workstation;

a feeder frame that is installed along the X-axis direction between the press machine and the sheet loader; and a plurality of guide rails that is installed on the upper surface of the feeder frame in parallel with the press line such that the guide rails guide and transfer the sheets.

2. The sheet loading system according to claim 1, wherein: the sheet loader includes a loader frame that has an overhead plate which is disposed over the conveyor, a Y-axis linear actuator that is installed on the overhead plate along the Y-axis direction, a lifting unit that is connected to the Y-axis linear actuator such that the lifting unit can be transferred along the Y-axis direction by the operation of the Y-axis linear actuator, and has a lifting plate which is lifted and lowered along the Z-axis direction, and a vacuum pad unit that is installed on the lifting plate, and has a plurality of vacuum pads for absorbing the sheets.

3. The sheet loading system according to claim 1, wherein: the first sheet transfer feeder includes a linear actuator that is installed on the feeder frame in parallel with the plurality of guide rails, and has a carriage which is transferred along the X-axis direction, and a clamping unit that is installed at the carriage so as to be able to clamp the sheets.

4. The sheet loading system according to claim 3, wherein: the second sheet transfer feeder includes a linear actuator that is installed on the feeder frame in parallel with the plurality of guide rails, and has a carriage which is transferred along the X-axis direction, a clamping unit that is installed at the carriage so as to be able to clamp the sheets, and an up down actuator that is installed at the carriage in order to lift and lower the clamping unit.

* * * * *